US007140048B2

(12) United States Patent
Wallerstein

(10) Patent No.: US 7,140,048 B2
(45) Date of Patent: Nov. 28, 2006

(54) BREATHABLE ARTICLE OF CLOTHING THAT RESISTS INSECT BITES

(76) Inventor: Robert S. Wallerstein, 9782 Tottenham Ct., Los Angeles, CA (US) 90210

( * ) Notice: Subject to any disclaimer, the term of this patent is extended or adjusted under 35 U.S.C. 154(b) by 350 days.

(21) Appl. No.: 10/859,990

(22) Filed: Jun. 4, 2004

(65) Prior Publication Data

US 2005/0278837 A1 Dec. 22, 2005

(51) Int. Cl.
*A41D 27/02* (2006.01)
*A41D 27/28* (2006.01)
*A41D 27/00* (2006.01)

(52) U.S. Cl. ..... 2/272; 2/93; 2/94; 2/243.1; 2/DIG. 1

(58) Field of Classification Search ..... 2/93–95, 2/97, 115, 117, 243.1, 258, 272, DIG. 1
See application file for complete search history.

(56) References Cited

U.S. PATENT DOCUMENTS 1,839,503 A * 1/1932 Russell ..... 2/242
2,074,390 A * 3/1937 Cole ..... 2/16
2,344,811 A 3/1944 Gill
4,716,594 A 1/1988 Shannon
5,005,215 A * 4/1991 McIlquham ..... 2/22
5,198,287 A * 3/1993 Samson et al. ..... 442/79
5,341,511 A * 8/1994 Wells ..... 2/456
5,343,564 A * 9/1994 Reynolds et al. ..... 2/70
5,357,635 A * 10/1994 Lemoine ..... 2/84
5,446,927 A 9/1995 Weldon
5,600,850 A * 2/1997 Shannon ..... 2/69
5,794,263 A * 8/1998 Carman ..... 2/84
6,141,802 A * 11/2000 Drake ..... 2/227
6,326,015 B1 * 12/2001 Tucci et al. ..... 424/403
6,728,969 B1 * 5/2004 Zeiler ..... 2/4
6,896,892 B1 * 5/2005 Mount et al. ..... 424/411
6,962,739 B1 * 11/2005 Kim et al. ..... 428/47
2002/0162161 A1 11/2002 Zeiler

* cited by examiner

*Primary Examiner*—Gary L. Welch
*Assistant Examiner*—Robert H Muromoto, Jr.
(74) *Attorney, Agent, or Firm*—Stites & Harbison PLLC; Ross F. Hunt, Jr.

(57) ABSTRACT

An article of clothing includes, in one embodiment, four alternate layers made of an air permeable material such as cotton and a non-air permeable material such as polyethyleneterephalate. Two intermediate layers both include a plurality of throughholes therein covered by the outer layers. The throughholes of the second layer are laterally offset from the throughholes of the third layer such that no direct path is provided through the throughholes between the intermediate layers so that the bites of insects are resisted. In another embodiment, two layers are provided each including a pattern, e.g., alternating stripes of an air permeable and a non-permeable material. The stripes of the two layers are offset so that non-permeable material of the two layers, taken together provide an insect barrier.

27 Claims, 2 Drawing Sheets

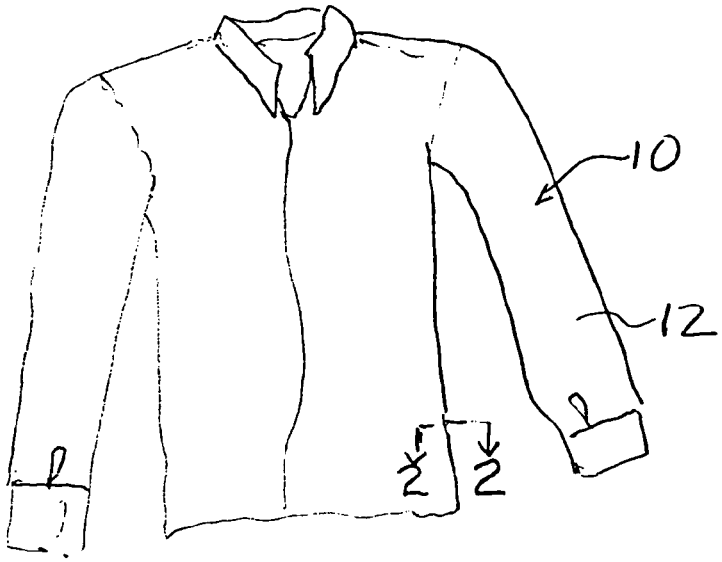
FIG. 1
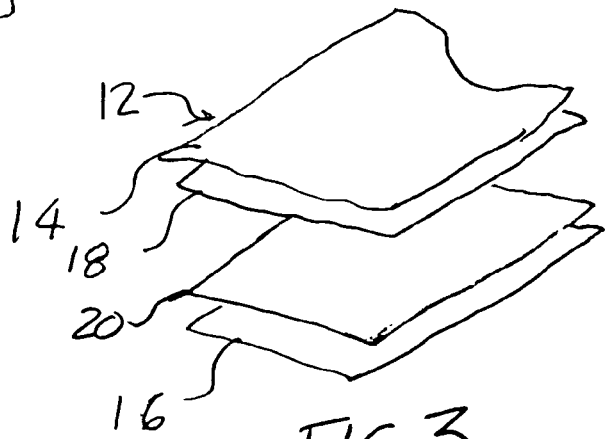
FIG. 3
FIG. 2
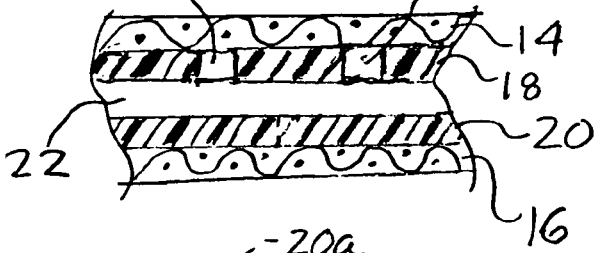
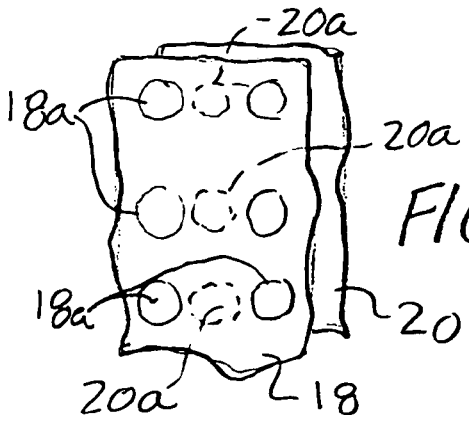
FIG. 4
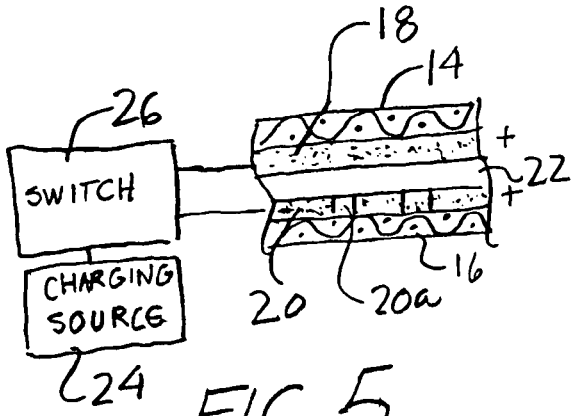
FIG. 5

BREATHABLE ARTICLE OF CLOTHING THAT RESISTS INSECT BITES

FIELD OF THE INVENTION

The invention relates to protective garments or articles of clothing which are intended to resist the bites or stings of insects.

BACKGROUND OF THE INVENTION

A relatively large number of fabrics and garments have been developed for providing protection against insect bites. Many of these garments, such as garments designed for beekeepers are specialized in nature, and many are heavy and cumbersome or otherwise limit movement or make movement awkward when worn. Such garments can also be uncomfortable to wear in hot weather or can feel overly confining or even suffocating because of the lack of breathability of the garment fabric. Still others are of limited effectiveness in providing protection real against insect bites and stings.

Some patents of potential interest in this field, or otherwise of possible related interest, include the following: U.S. Pat. and Publication No. U.S. Pat. No. 5,600,850 to Shannon; 2002/0162161 to Zeiler; U.S. Pat. No. 4,716,594 to Shannon; U.S. Pat. No. 5,357,635 to Lemoine; U.S. Pat. No. 2,344,811 to Gill; and U.S. Pat. No. 5,446,927 to Weldon.

Briefly considering the foregoing, the Shannon patent discloses a garment for protection against insects comprising an outer layer of mesh material for preventing the passage of insects and an inner layer of material having a series of arches. Each arch of the series of arches has a height greater than or equal to approximately 1/16 of an inch so that the arches elevate the outer layer from the skin surface of the wearer and thus insects cannot sting or bite the wearer.

The Zeiler patent application publication discloses an insect barrier garment including a lower body, an upper body, and a hood formed of a textile material all of which inhibit the ability of insects to sting a wearer. The textile material of the garment comprises a base fabric and a cover fabric separated by a spacer layer. The base and cover fabric are open to facilitate breathability. The spacer layer separates the base fabric from the cover fabric by a sufficient distance to inhibit insects from probing through the textile to reach the wearer.

The Shannon patent discloses a garment comprising inner and outer layers of fabric. The outer layer of fabric is constructed so as to prevent passage of mosquitoes and other insects. The inner layer of fabric is a coarse mesh fabric with relatively large openings therein and is many times thicker than the thickness of the outer layer of fabric so as to serve as a spacer layer. This layer spaces the skin of the wearer of the garment at a distance from the outer surface of the garment such that mosquitoes cannot reach the skin of the wearer so as to bite the wearer.

The Lemoine patent discloses a beekeeper's suit including an outside layer comprising a netting of flexible material having openings therein, an inside layer which is similar to the outside layer in structure and an intermediate layer which is sandwiched between the outside and the inside layer. The intermediate layer is formed from a flexible porous cellular plastic material.

The Gill patent discloses an insect repelling fabric including a supporting web structure comprising intersecting rubber strips. Overlying the supporting web structure is a fabric netting formed of cotton.

The Weldon patent, which also does not relate to resisting insect bites, discloses a garment for facilitating the evaporative cooling of the epidermis of a user while protecting the epidermis from sunlight. The garment includes two co-extensive layers of material each having openings formed therein. The layers slide over one other to move openings in one layer partially out of registration with openings in another layer so that sunlight is prevented from penetrating the garment on a continuous basis. The openings in the garment are arranged such that at any given time some of the openings of the two layers are in partial registration and thus facilitate the flow of air through the garment to assist in the evaporative cooling of the epidermis of a user.

Other patents and published applications disclosing insect repelling garments include 2003/0166372 to Howard; 2002/0124293 to Zeiler; 2002/0137410 to Porter et al; and U.S. Pat. No. 5,214,797 to Tisdale.

SUMMARY OF THE INVENTION

In accordance with the invention, there is provided an article of clothing which is constructed so as to overcome or significantly ameliorate the problems of the prior art. In this regard, the clothing article of the garment of the invention provides protection against the bits and stings of insects while still being of a breathable, relatively flexible construction which is not confining and which is of moderate to light weight depending on the thicknesses of the various layers employed.

In accordance with one aspect of the invention, there is provided an article of clothing comprising:

a first, outer layer of an air permeable material;

a second layer of a non-air permeable material in contact with the first layer;

a third layer of a non-air permeable material disposed adjacent to the second layer; and a fourth, inner layer of an air permeable material in contact with the third layer;

the second layer including a plurality of throughholes therein covered by the first layer, the third layer also including a plurality of throughholes therein covered by the fourth layer, and the throughholes of the second layer being laterally offset from the throughholes of the third layer so that no direct path is provided through the throughholes between the second and third layers.

Preferably, the first layer comprises natural fibers. Advantageously, the first layer comprises cotton. In a preferred implementation, the fourth layer also comprises natural fibers and, more preferably, comprises cotton.

Preferably, the second layer comprises a substantially elastomeric, nonporous material. Advantageously, the second layer comprises polyethyleneterephalate. In a preferred implementation, the third layer also comprises a substantially elastomeric, nonporous material and, more preferably, the third layer comprises polyethyleneterephalate.

Preferably, at least a part of the second layer is spaced from at least part of said third layer so as to create an air space between said second and third layers. Advantageously, the air space is variable in size.

In an alternative embodiment of this aspect of the invention, the second and third layers are constructed so as to carry electrical charges of variable polarity and the article of clothing further comprises means for varying the polarity of the charge carried by the second and third layers so as to control the creation and collapsing of a space between the second and third layers.

In accordance with a related aspect of the invention, there is provided an article of clothing comprising:

a first layer of an air permeable natural fiber material;

a second layer of a non-air permeable, substantially elastomeric material secured to the first layer;

a third layer of a non-air permeable, substantially elastomeric material disposed adjacent to the second layer; and a fourth layer of an air permeable natural fiber material secured to the third layer;

the second layer including a plurality of throughholes therein covered by the first layer, said third layer including a plurality of throughholes therein covered by the fourth layer, and the throughholes of the second layer being laterally offset from the throughholes of the third layer so that no direct path is provided through the throughholes between the second and third layers.

Preferably, at least one of the second and third layers comprises polyethyleneterephalate, and more preferably, both the second and third layers comprises polyethyleneterephalate.

Advantageously, at least a part of the second layer is spaced from at least part of said third layer so as to create an air space between the second and third layers.

In one embodiment of this aspect of the invention, the second and third layers are constructed so as to carry electrical charges of variable polarity and the article of clothing further comprises means for varying the polarity of the charge carried by the second and third layers so as to control the creation and collapsing of a space between the second and third layers.

In accordance with yet another aspect of the invention, there is provided an article of clothing comprising:

a first layer comprising alternate, parallel extending sections of (i) an air permeable material and (ii) a substantially impermeable material;

a second layer comprising alternate, parallel extending sections of (i) an air permeable material and (ii) a substantially impermeable material;

the substantially air permeable sections of the first and second layers being offset from each other and being in substantial alignment with the substantially impermeable sections of the second and first layers, respectively, so that the substantially impermeable sections of the first and second layers, taken together, form a substantially impermeable barrier which resists the bites and stings of insects and the like.

Preferably, the first and second layers are stitched together at spaced locations so as to created an air space therebetween. In a preferred implementation, the substantially impermeable material of said first and second layers comprises separate spaced parallel strips of substantially impermeable material attached to a layer of said air permeable material.

According to a further aspect of the invention, there is provided an article of clothing comprising a first layer comprising a first pattern formed by sections of (i) an air permeable material and (ii) a substantially impermeable material, a second layer comprising a second pattern formed by sections of (i) an air permeable material and (ii) a substantially impermeable material, air permeable sections of the first and second patterns of the first and second layers being offset from each other and being in substantial alignment with the substantially impermeable sections of the second and first layers, respectively, so that the substantially impermeable sections of the first and second layers, taken together, form a substantially impermeable barrier to insect bites and stings.

Further features and advantages of the present invention will be set forth in, or apparent from, the detailed description of preferred embodiments thereof which follows.

BRIEF DESCRIPTION OF THE DRAWINGS

FIG. 1 is a front elevational view of an article of clothing made of, or otherwise incorporating, a protective material in accordance with one preferred embodiment of the invention;

FIG. 2 is a cross sectional view of a single thickness of the material of FIG. 1;

FIG. 3 is an exploded perspective view of the material of FIG. 2 showing the various layers forming the material of this embodiment;

FIG. 4 is a broken away, plan view of two overlaid layers of the material of FIG. 2;

FIG. 5 is a schematic cross sectional view, partially in block form, of a further implementation of this embodiment of the invention.

DESCRIPTION OF THE PREFERRED EMBODIMENTS

Figure 6:
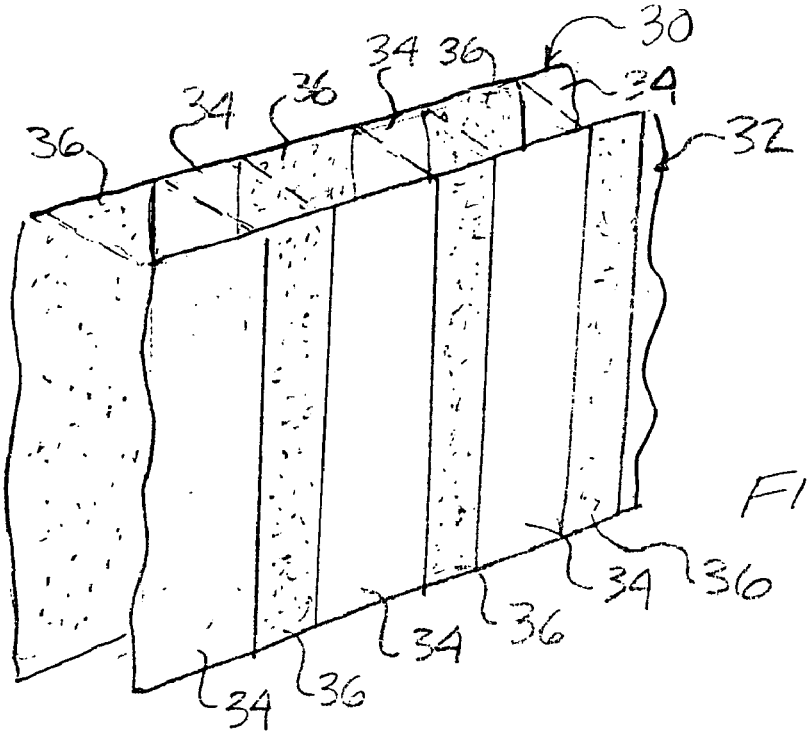
FIGS. 6, 7 and 8 are an exploded perspective view, a front elevational view and a side elevational view, respectively, of a portion of an article of clothing made of, or otherwise incorporating, a protective material in accordance with a further preferred embodiment of the invention.

Referring to FIG. 1, there is shown a garment or article of clothing 10 which is made of or otherwise incorporates the fabric or material of the present invention. It will be understood that although a long-sleeved shirt is shown in FIG. 1 the article of clothing can take many different forms and can, for example, comprise a full body suit or other like garment typically covering most, if not all, of the body of the wearer, apart from, e.g., eye and/or mouth openings.

As shown in FIGS. 2 and 3, the material used to make the article of clothing 10, which is denoted 12 in FIGS. 1 to 3, preferably comprises an outer layer 14 of an air permeable material and an inner layer 16 of an air permeable material. Preferably but not necessarily, the same material is used for both layers and this material is most preferably a natural fiber fabric such as cotton, although synthetic materials such as those made from nylon, rayon, glass and polyester fibers can also be used.

The outer layer 14 is secured by sewing, bonding or the like to a first intermediate layer 18 made of a non-air permeable or nonporous material. Layer 18 is preferably elastomeric and, in a preferred embodiment, is polyethyleneterephalate. In a more preferred embodiment, layer 18 is made of the commercial form of polyethyleneterephalate sold by Dupont under the trademark MYLAR® which in some forms comes with an adhesive coating that is exposed by peeling off a covering peel-off strip. Of course, in this latter embodiment, this adhesive coating can be used to join layer 18 to layer 14. A number of other substantially nonporous materials can be used including those formed from a long chain synthetic polymer of dihydric-alcohols and aromatic dicarboxilic acids and esters such as polybutyleneterephalate.

The inner layer 16 is similarly secured to a second intermediate layer 20. Layer 20 is similar to first intermediate layer 18 and, in one preferred embodiment, is made of the same material. Both layers 18 and 20 have respective holes 18*a* and 20*a* provided therein (see also FIG. 4) which are discussed in more detail below. Apart from this difference, in a more preferred embodiment, the layers 18 and 20 are made of the same material as indicated above, are affixed to the respective layers 12 and 14 in the same way, and differ only in the hole patterns provided in layers 18 and 20.

A space 22 is preferably created between intermediate layers 18 and 20 which acts as an insulating space or layer within protective material 12. This space 22 can be created in a number of different ways including special sewing or other joining together of the adjacent layers, crimping or quilting of one or more layers to create an air pocket or pockets, adding a highly porous central layer and the like. A further embodiment creating such an insulating space is discussed below in connection with FIG. 5.

Referring to FIG. 4, a broken away plan view of layers 18 and 20 is shown which illustrates one pattern of holes 18*a* and 20*a* in the respective layers 18 and 20. An important feature of the relative positioning of holes 18*a* and 20*a* is that these holes are offset from each other, as shown in FIG. 4, so that there is no direct path through the layers 18 and 20 as would be the case if the holes 18*a* and 20*a* were in registration, or in partial registration, with each other. It will be appreciated that this lack of a direct path through non-porous layers 18 and 20 prevents insect bites and stings. It will also be understood that FIG. 4 is merely illustrative of one of many possible embodiments, and that the pattern of holes 18*a*, 20*a* and the sizes of the holes 18*a*, 20*a* can be varied within wide limits, and can be chosen depending on the application, the desired layer thickness, the strength of the material used for layers 18, 20 so as to, e.g., make it resistive to tearing, and the like.

Referring to FIG. 5, a further embodiment is illustrated wherein the first and second intermediate layer 18 and 20 have incorporated therein a conductive, preferably metallic, component or components, in the form of, e.g., random metallic elements, an intermediate metal layer, a plurality of metallic strips or the like, which enable an electrical charge to be imparted thereto. This can be readily achieved with many materials and some materials incorporating such conductive components are commercially available. As illustrated schematically in FIG. 5, the layers 18 and 20 are each connected to charging source 24 through a switch 26 so that a like charge can be imparted to the two layers 18 and 20 to cause separation of the layers and thus create an air space 22 therebetween. This space 22 can be collapsed by changing the charge pattern so that the two layers 18 and 20 are mutually attracted to one another or are no longer mutually repulsive.

Using well known technologies, charging source 24 and switch 26 can be implemented using miniaturized circuits so that they can be easily carried on the person of the wearer of the article of clothing and can be made to be completely unobtrusive.

Figure 8:
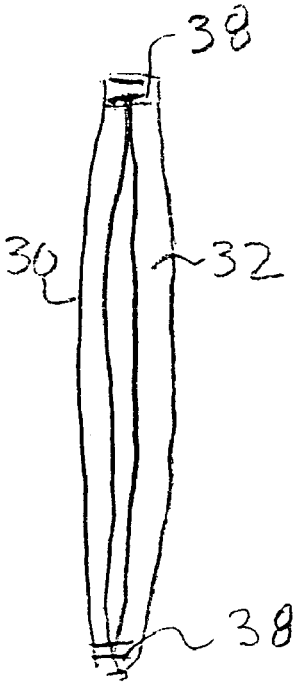
Figure 7:
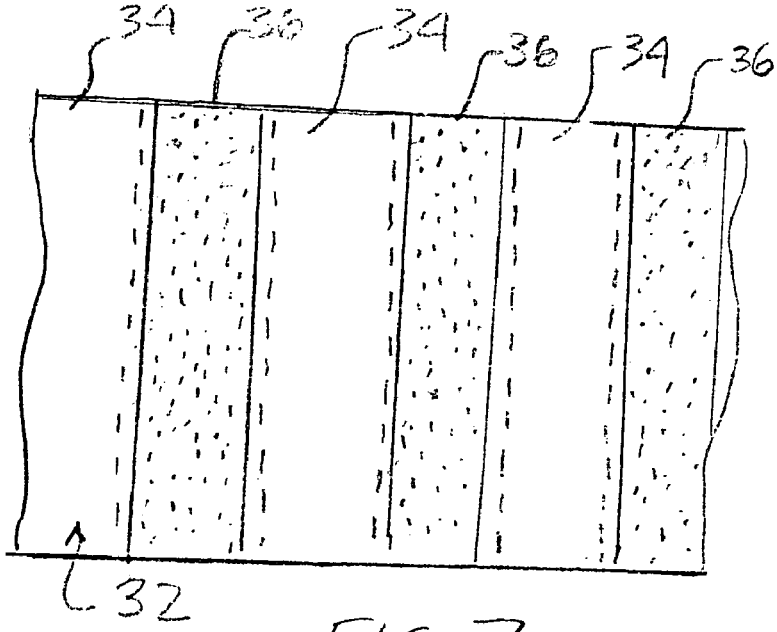

Referring to FIGS. 6, 7 and 8, a further preferred embodiment is shown. This embodiment is particularly advantageous because of the simplicity of manufacture thereof, the pleasing appearance presented and the effectiveness of the barrier to insect bites and stings provided thereby. In this embodiment, each of two layers or plies 30 and 32 includes a "striped" pattern produced by alternate sections, denoted 34 and 36, respectively, of (i) a substantially non-permeable, e.g., a tight weave, material and, (ii) an air permeable, e.g., a sheer or porous weave, material. In general, the substantially non permeable material should be such as to prevent insect bites and stings. Importantly, as shown in FIG. 6, the two layers 30 and 32 are offset from each other so that the non-permeable sections 34 of layer or ply 30 are aligned with, i.e., in registration with, the air permeable sections 36 of layer or ply 32 and the air permeable sections 36 of layer 30 are aligned with the non-permeable sections 34 of layer 32. Because of this offsetting of the non-permeable sections 34, there is no direct path through the non-permeable material of sections 34 of the two layers 30 and 32 so that protection in the form of a non-permeable barrier is provided against insect bites. Moreover, the air permeable sections 36 provide the fabric construction with breathability.

As shown in FIG. 7, non-permeable sections 34 may be stitched, by stitching 38, to an air permeable sheet to form the alternating non-permeable sections 34 and the air permeable sections 36.

As indicated schematically in FIG. 8, in one preferred embodiment, the two layers or plies 30 and 32 are loosely stitched together or otherwise loosely joined together so as to add to breathability of the resultant fabric or garment.

It will be understood that although a "striped" pattern has been shown in FIGS. 6 and 7, other patterns formed by sections of substantially non-permeable and air permeable materials can also be employed. For example, a pattern of squares or checks can be formed, with the square air permeable sections of the first layer being aligned with substantially non permeable sections of the second layer of the same size and square shape and the square substantially non-permeable sections of the first layer being aligned with air permeable sections of the second layer of the same size and square shape, as discussed above. It will be appreciated that other patterns and shapes can obviously be used, and that precise alignment between the sections of the two layers is not required so long as the non-permeable sections of the two layers, taken together, form an effective barrier to insect bites and stings.

Although the invention has been described above in relation to preferred embodiments thereof, it will be understood by those skilled in the art that variations and modifications can be effected in these preferred embodiments without departing from the scope and spirit of the invention.

What is claimed is:

1. An article of clothing comprising:

a first, outer layer of an air permeable fabric material;

a second layer of a non-air permeable material in contact with said first layer;

a third layer of a non-air permeable material disposed adjacent to said second layer; and a fourth, inner layer of an air permeable material in contact with said third layer;

said second layer including a plurality of throughholes therein covered by said first layer, said third layer including a plurality of throughholes therein covered by said fourth layer, and the throughholes of the second layer being laterally offset from the throughholes of the third layer so that no direct path is provided through said throughholes between the second and third layers.

2. An article of clothing according to claim 1 wherein said first layer comprises natural fibers.

3. An article of clothing according to claim 2 wherein said first layer comprises cotton.

4. An article of clothing according to claim 3 wherein said fourth layer comprises cotton.

5. An article of clothing according to claim 1 wherein said fourth layer comprises natural fibers.

6. An article of clothing according to claim 5 wherein said fourth layer comprises cotton.

7. An article of clothing according to claim 1 wherein said second layer comprises a substantially elastomeric, nonporous material.

8. An article of clothing according to claim 1 wherein said second layer comprises polyethyleneterephalate.

9. An article of clothing according to claim 8 wherein said third layer comprises polyethyleneterephalate.

10. An article of clothing according to claim 1 wherein said third layer comprises a substantially elastomeric, non-porous material.

11. An article of clothing according to claim 1 wherein said third layer comprises polyethyleneterephalate.

12. An article of clothing according to claim 1 wherein at least a part of the second layer is spaced from at least part of said third layer so as to create an air space between said second and third layers.

13. An article of clothing according to claim 12 wherein said air space is variable in size.

14. An article of clothing according to claim 1 wherein said second and third layers are constructed so as to carry electrical charges of variable polarity and wherein said article of clothing further comprises means for varying the polarity of the charge carried by the second and third layers so as to control the creation and collapsing of a space between the second and third layers.

15. An article of clothing comprising:

a first layer of an air permeable natural fiber material;

a second layer of a non-air permeable, substantially elastomeric material secured to said first layer;

a third layer of a non-air permeable, substantially elastomeric material disposed adjacent to said second layer; and a fourth layer of an air permeable natural fiber material secured to said third layer;

said second layer including a plurality of throughholes therein covered by said first layer, said third layer including a plurality of throughholes therein covered by said fourth layer, and the throughholes of the second layer being laterally offset from the throughholes of the third layer so that no direct path is provided through said throughholes between the second and third layers.

16. An article of clothing according to claim 15 wherein said second layer comprises polyethyleneterephalate.

17. An article of clothing according to claim 16 wherein said third layer comprises polyethyleneterephalate.

18. An article of clothing according to claim 15 wherein said third layer comprises polyethyleneterephalate.

19. An article of clothing according to claim 1 wherein at least a part of the second layer is spaced from at least part of said third layer so as to create an air space between said second and third layers.

20. An article of clothing according to claim 15 wherein said second and third layers are constructed so as to carry electrical charges of variable polarity and wherein said article of clothing further comprises means for varying the polarity of the charge carried by the second and third layers so as to control the creation and collapsing of a space between the second and third layers.

21. An article of clothing comprising:

a first layer of comprising alternate, parallel extending sections of (i) an air permeable material and (ii) a substantially impermeable material;

a second layer comprising alternate, parallel extending sections of (i) an air permeable material and (ii) a substantially impermeable material;

said air permeable sections of the first and second layers being offset from each other and being in substantial alignment with the substantially impermeable sections of the second and first layers, respectively, so that the substantially impermeable sections of the first and second layers, taken together form a substantially impermeable barrier to insect bites and stings.

22. An article of clothing according to claim 21 wherein said first and second layers are stitched together at spaced locations so as to create an air space therebetween.

23. An article of clothing according to claim 21 wherein said substantially impermeable material of said first and second layers comprises separate spaced parallel strips of substantially impermeable material attached to a layer of said air permeable material.

24. An article of clothing comprising:

a first layer comprising a first pattern formed by sections of (i) an air permeable material and (ii) a substantially impermeable material;

a second layer comprising a second pattern formed by sections of (i) an air permeable material and (ii) a substantially impermeable material;

said air permeable sections of the first and second patterns of the first and second layers being offset from each other and being in substantial alignment with the substantially impermeable sections of the second and first layers, respectively, so that the substantially impermeable sections of the first and second layers, taken together, form a substantially impermeable barrier to insect bites and stings.

25. An article of clothing according to claim 24 wherein said first and second patterns each comprise alternating parallel extending sections of said air permeable material and said substantially impermeable material.

26. An article of clothing according to claim 24 wherein said first and second layers are stitched together at spaced locations so as to create an air space therebetween.

27. An article of clothing according to claim 24 wherein said substantially impermeable material of said first and second layers comprises separate spaced parallel strips of substantially impermeable material attached to a layer of said air permeable material.

* * * * *